US012357112B2

(12) United States Patent
Welsh et al.

(10) Patent No.: US 12,357,112 B2
(45) Date of Patent: Jul. 15, 2025

(54) THEFT DETERRENT SYSTEM

(71) Applicant: SENNCO SOLUTIONS, INC., Plainfield, IL (US)

(72) Inventors: Silas Welsh, Plainfield, IL (US); Jennifer Pedersen, Chicago, IL (US); Ryan G'Fellers, Montgomery, IL (US); Christopher Marszalek, Plainfield, IL (US); Andy Reynolds, Aurora, IL (US)

(73) Assignee: SENNCO SOLUTIONS INC., Plainfield, IL (US)

( * ) Notice: Subject to any disclaimer, the term of this patent is extended or adjusted under 35 U.S.C. 154(b) by 328 days.

(21) Appl. No.: 18/100,335

(22) Filed: Jan. 23, 2023

(65) Prior Publication Data

US 2023/0233000 A1 Jul. 27, 2023

Related U.S. Application Data

(60) Provisional application No. 63/301,890, filed on Jan. 21, 2022.

(51) Int. Cl.
*A47F 3/00* (2006.01)
*A47F 1/12* (2006.01)

(52) U.S. Cl.
CPC ..... *A47F 3/002* (2013.01); *A47F 1/126* (2013.01)

(58) Field of Classification Search
CPC . A47F 3/002; A47F 1/12; A47F 1/126; A47B 96/00; A47B 96/02; A47B 96/027
See application file for complete search history.

(56) References Cited

U.S. PATENT DOCUMENTS 1,718,249 A * 6/1929 Morin ..... A47F 3/002 109/51
4,130,326 A * 12/1978 Hornblad ..... A47F 3/002 312/42
4,682,825 A 7/1987 Crosslen
5,408,775 A 4/1995 Abramson et al.
6,047,647 A 4/2000 Laraia, Jr.
(Continued)

FOREIGN PATENT DOCUMENTS

DE 10259397 A1 * 7/2004 ..... A47F 3/002
DE 102012101421 A1 * 8/2013 ..... A47F 1/12
(Continued)

OTHER PUBLICATIONS

PCT International Search Report, Form PCT/ISA/210, for International Application PCT/US2023/011334, Jan. 23, 2023 (3 pages).
(Continued)

*Primary Examiner* — Stanton L Krycinski
(74) *Attorney, Agent, or Firm* — Pauley Erickson & Swanson

(57) ABSTRACT

A theft deterrent system for mounting on a retail shelf that includes a receiver to attach to the retail shelf and a plurality of gates positioned along the receiver. Each gate of the plurality of gates is arranged to swing open from the receiver. A plurality of blockers is arranged in a slidable manner along the receiver. Each blocker provides audible feedback as it slides relative to the receiver. Each blocker prevents a respective underlying gate to swing open from the receiver.

17 Claims, 13 Drawing Sheets

(56) References Cited

U.S. PATENT DOCUMENTS

| | | | | |
|---|---|---|---|---|
| 6,434,871 | B2 * | 8/2002 | Conway | G09F 3/204 40/642.02 |
| 7,150,365 | B2 * | 12/2006 | Hardy | A47F 3/002 211/189 |
| 8,152,006 | B2 * | 4/2012 | Wamsley | A47F 5/005 211/119.003 |
| 8,167,149 | B2 | 5/2012 | Wamsley et al. | |
| 8,622,227 | B2 * | 1/2014 | Bird | A47F 3/002 211/119.003 |
| 8,973,765 | B2 | 3/2015 | Wamsley et al. | |
| 11,357,341 | B2 * | 6/2022 | Ewing | A47F 3/002 |
| 11,540,628 | B2 * | 1/2023 | Brück | G08B 13/1436 |
| 11,647,849 | B2 * | 5/2023 | Horvath | A47F 10/02 49/14 |
| 12,059,084 | B2 * | 8/2024 | Hua | A47F 1/12 |
| 2001/0026115 | A1 | 10/2001 | Hakemann | |
| 2005/0161420 | A1 | 7/2005 | Hardy et al. | |
| 2008/0283477 | A1 | 11/2008 | Wamsley et al. | |
| 2021/0106148 | A1 | 4/2021 | Horvath et al. | |

FOREIGN PATENT DOCUMENTS

| | | | | |
|---|---|---|---|---|
| EP | 1692977 | A1 * | 8/2006 | A47F 3/002 |
| WO | WO 2008/088789 | A2 | 7/2008 | |

OTHER PUBLICATIONS

PCT Written Opinion of International Searching Authority, Form PCT/ISA/237, for International Application PCT/US2023/011334, Jan. 23, 2023 (4 pages).

* cited by examiner

THEFT DETERRENT SYSTEM

CROSS REFERENCE TO RELATED APPLICATION

This application claims the benefit of U.S. Provisional Patent Application, Ser. No. 62/301,890, filed on 21 Jan. 2022. The co-pending Provisional Application is hereby incorporated by reference herein in its entirety and is made a part hereof, including but not limited to those portions which specifically appear hereinafter.

BACKGROUND OF THE INVENTION

Field of the Invention

This invention relates generally to a theft deterrent system and, more particularly, to a theft deterrent system to protect items on retail shelves.

Description of Prior Art

A growing problem for retail stores is theft of high value inventory directly from shelves, Thieves target retail stores to "sweep" shelves of valuable product by quickly assembling and removing as much of the product as possible. They then exit the store with the product before store personnel or law enforcement have an opportunity to react. The product is either later returned for cash or sold outright.

Solutions to this problem have included locking down high value product in vaults or cabinets that require store personnel to unlock and physically provide the product to the consumer. Other solutions include security wires that physically connect the product to store shelves or each other. These solutions also require store personnel to unlock and untether such product for the consumer. These solutions tend to discourage customers from purchases because of the extra effort and time required to examiner and attain a product for purchase.

Other solutions utilize mechanical dispensers connected to shelves that are configured to mechanically dispense one product at a time before resetting for dispensing another product. These solutions are not flexible for a variety of inventory and this inflexibly requires particular store shelves to be dedicated to particular inventory.

A need therefore exists in a retail system to slow suspected thieves down, maintain inventory and alert store staff regarding interest while also enabling shoppers to examine and purchase product unencumbered by lock and key solutions.

SUMMARY OF THE INVENTION

The invention generally relates to a theft deterrent system that can be used on a retail shelf to protect certain goods from theft.

The general object of the invention can be attained, at least in part, through a theft deterrent system for mounting on a retail shelf. The theft deterrent system includes a receiver configured to attach to a retail shelf and a plurality of gates positioned along the receiver. Each gate of the plurality of gates is arranged to swing open from the receiver.

The theft deterrent system also includes a plurality of blockers arranged in a slidable manner along the receiver, Each blocker of the plurality of blockers preferably provides audible feedback as it slides relative to the receiver. Each blocker preferably prevents one or more respective underlying gates of the plurality of gates from swinging open from the receiver.

The plurality of gates preferably number at least one more than the plurality of blockers. The plurality of gates are also preferably transparent or otherwise provide visual access to the respective retail shelf. The plurality of blockers are each arranged to slide freely in a lateral direction relative to the receiver.

The theft deterrent system may also include a blocker frame mounted along the receiver. The plurality of blockers are positioned along the blocker frame. The audible feedback may include a series of clicks as the blocker is moved relative to the blocker frame. The theft deterrent system may also include a gate mount assembly mounted along the receiver. The plurality of gates are positioned along the gate mount assembly. The gate mount assembly includes a gate frame and a hinge assembly for positioning the plurality of gates. A guard strip may also be included on the theft deterrent system attached to the receiver above the plurality of gates and plurality of blockers.

Other objects and advantages will be apparent to those skilled in the art from the following detailed description taken in conjunction with the appended claims and drawings.

DETAILED DESCRIPTION OF THE INVENTION

The present invention provides a system including a series of doors or gates that can be mounted relative to a retail shelf to prevent theft of various items.

Figure 1:
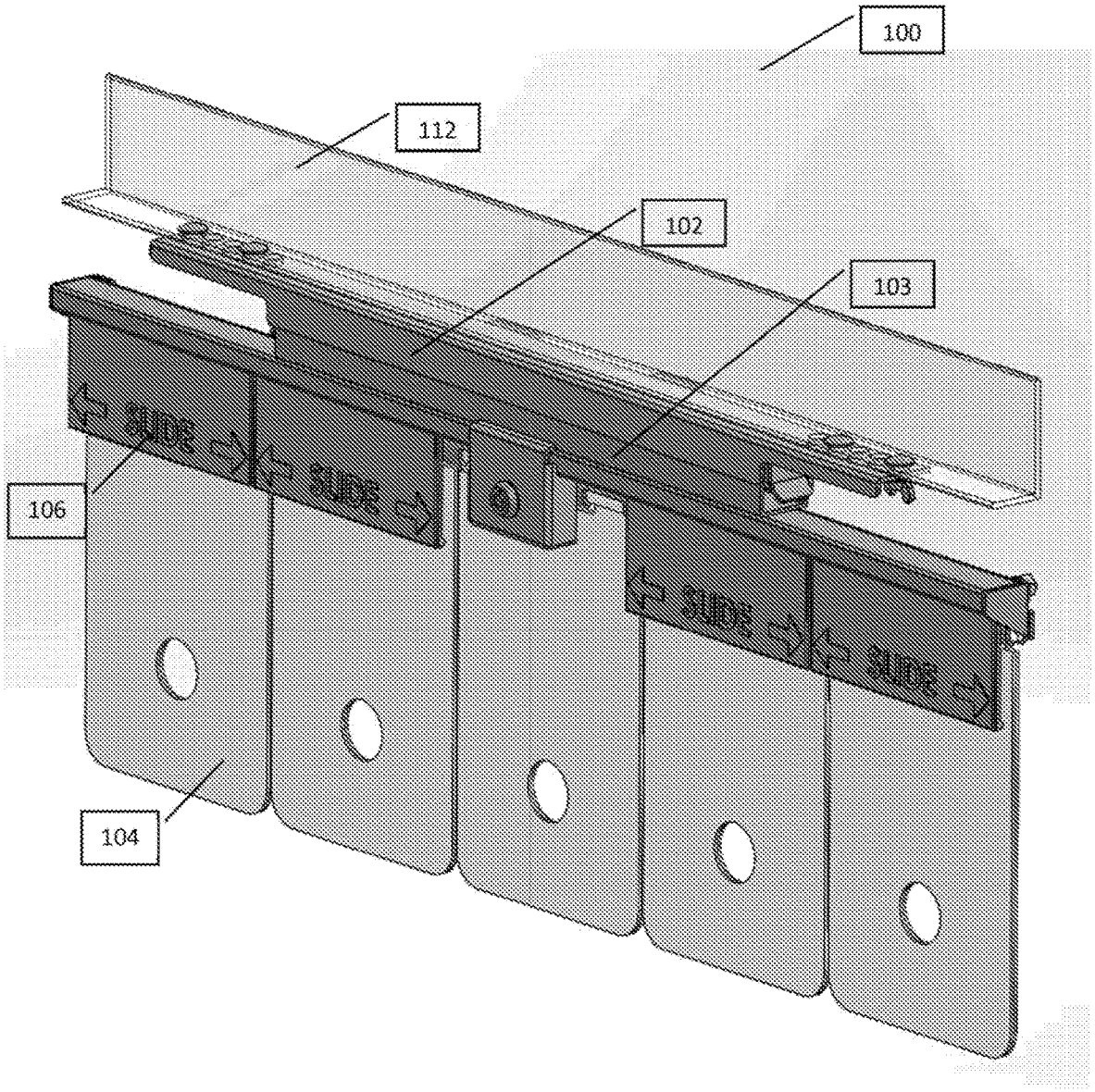
FIG. 1 shows a perspective view of a theft deterrent system according to one embodiment of the invention.

FIG. 1 shows a theft deterrent system 100 that can be mounted relative to a retail shelf (not shown), The theft deterrent system 100 includes a receiver 102 that is preferably mounted to the shelf. The receiver 102 connects to a frame 103 that includes a plurality of gates 104 that hang down along a length of the frame 103. As shown in FIG. 1, along an upper edge of the plurality of gates 104, a plurality of blockers 106 are also attached relative to the length of the frame 103. The blockers 106 are preferably mounted to a blocker channel 108 that is connected to the frame 103. The blockers 106 are preferably slidable along the blocker frame 108. As used herein, the term "blocker" is intended to mean a device capable of blocking one or more gates 104 from opening and/or closing.

Figure 2:
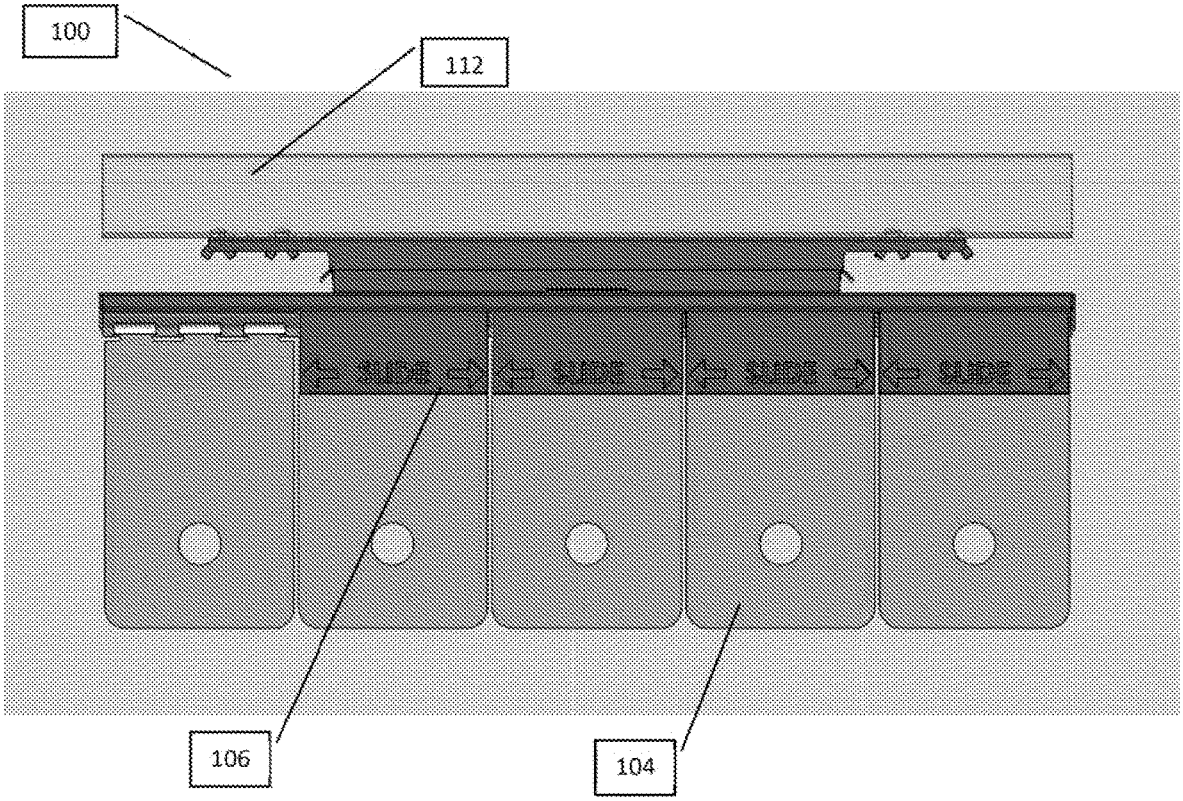
FIG. 2 shows a front view of a theft deterrent system according to the embodiment shown in FIG. 1.

FIG. 2 shows a front view of the theft deterrent system 100. As shown, the number of blockers 106 is preferably one or more less than the plurality of gates 104, FIG. 2 shows five gates 104 and four blockers 106, however a useable system may permit some other combination of gates 104 and blockers 106 that permit selective movement of respective blockers 106 from an area in front of a desired gate 104 to be lifted. The blockers 106 are preferably slidable in a linear direction along a length of the frame 103, whereas the gates 104 are fixed in a linear position but are mounted to the frame 103 in a pivoting manner so that each gate 104 can be swung between an open and closed position.

Figure 3:
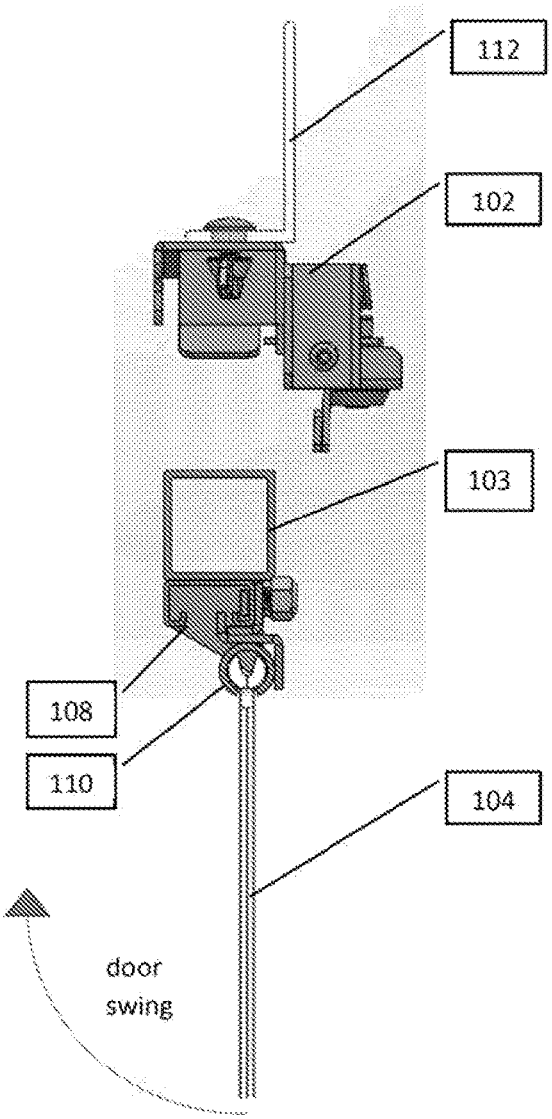
FIG. 3 shows a side cross-sectional view of a theft deterrent system according to the embodiment shown in FIG. 1.

FIG. 3 shows a side, cross-sectional exploded view of the theft deterrent system 100 without any blockers 106 in place. The system 100 includes a gate mount hinge detail 110 so that each gate 104 may swing or pivot in relation to the frame 103. The gates 104 are preferably sized to at least partially block or cover a row of product on the retail shelf (such as deodorant, razor blades, etc.) so that when a gate 104 swings open, it allows a consumer to remove the retail item behind that particular gate 104 but when the gate 104 is closed, it does not permit access and removal of the respective retail item.

Figure 4:
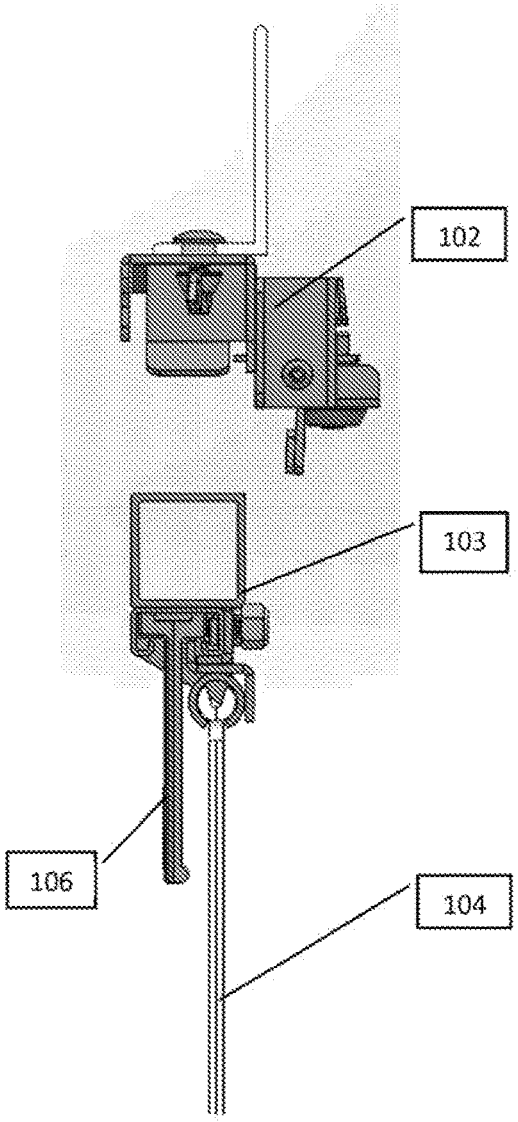
FIG. 4 shows a side cross-sectional view of a theft deterrent system according to the embodiment shown in FIG. 1.

However, when a blocker 106 is present in front of a gate 104, as shown in FIG. 4, the gate 104 cannot swing open as the blocker 106 blocks the pivoting movement of the gate 104. The components of the blockers and gates are preferably connected to the frame 103 which mounts to a retail shelf by a receiver 102. The receiver 102 fastens to a retail shelf and may additionally fasten to a product blocker 112 mounted above at least a portion of a receiver 102.

Figure 5:
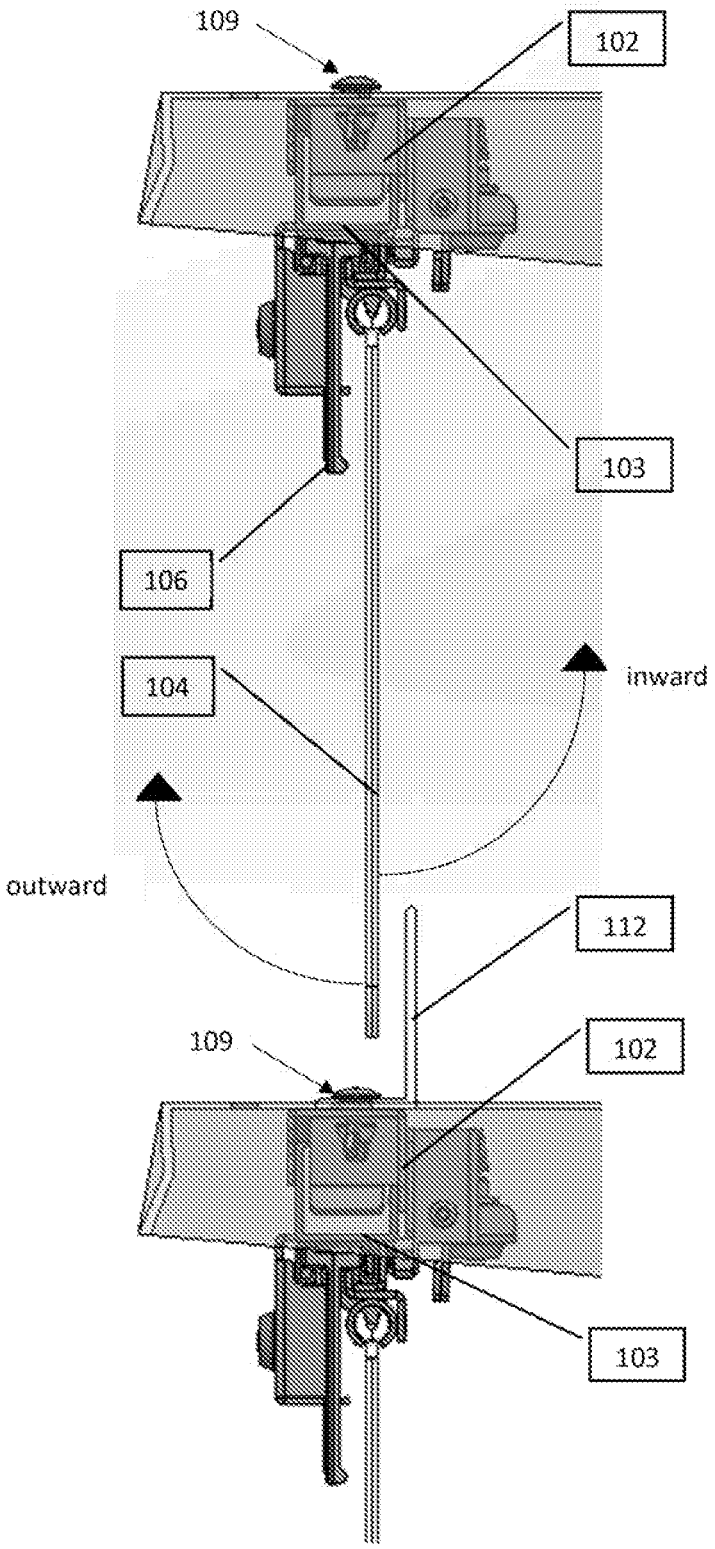
FIG. 5 shows a side cross-sectional view of a theft deterrent system including two shelves according to the embodiment shown in FIG. 1.

FIG. 5 shows two stacked shelves each having the system 100 according to this invention. A product blocker 112 on a lower adjacent shelf is used to prevent inward swing of the gate 104, The product blocker 112 is preferably fastened to the retail shelf below the gate 104 using a simple fastener 109 like a screw or a bolt. If another gate system 100 is on the next shelf below, the product blocker fastens to the shelf and that next gate system.

Having slidable blockers 106 that number one or more less than the number of gates 104 allows only one gate 104, and/or less than all, to be accessible at a time, therefore providing a protection of the product from thieves, while also allowing consumers to grab a desired product without needing the assistance of a store clerk. However, it may be alternatively desirable to include some other relationship between the number of blockers and the number of gates. For instance, it may be desirable to include a concentration of blockers 106 along one group of gates 104 and minimal or no blockers along an adjacent group of gates 104, depending on the nature of the product on the shelf.

Figure 6:
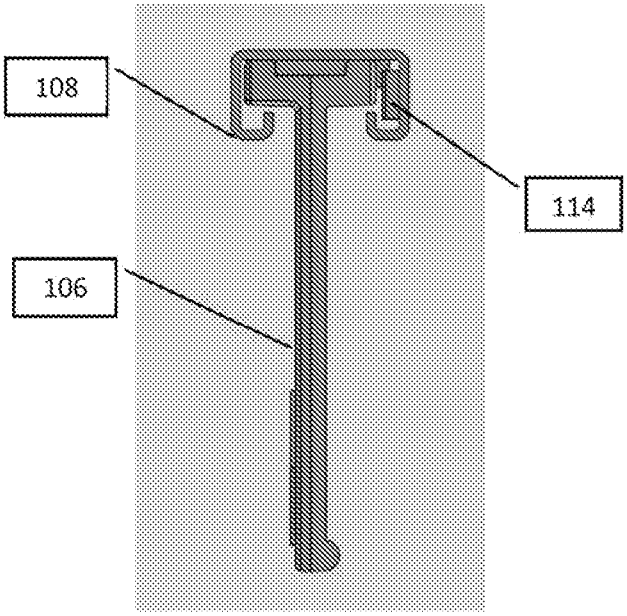
FIG. 6 shows a side cross-sectional view of a theft deterrent system according to one embodiment of the invention.

FIG. 6 shows another cross-sectional view of the theft deterrent system 100 where the blocker frame 108 is presented as a channel to hold the blockers 106, and through which the blockers 106 can slide therethrough. As shown in the partially: transparent perspective view of FIG. 7, the blockers 106 can encompass varying lengths and widths, and may also include visible instructions for use to consumers such as the "slide" instruction presented in FIG. 7.

Figure 7:
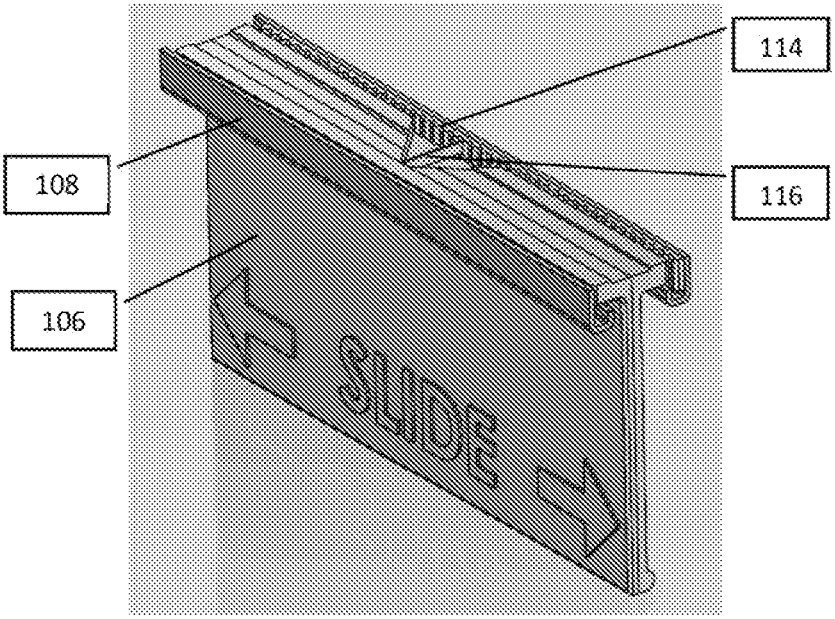
FIG. 7 shows a partial perspective view of a theft deterrent system according to the embodiment shown in FIG. 6.

As best shown in FIG. 7, the blocker frame 108 may also include a corrugated strip 114 on an inner side of the blocker frame 108. The corrugations of the strip 114 preferably extends parallel to a sliding path of each blocker 106. To interact with the corrugated strip 114, the blocker 106, as shown, may include a tab 116 protruding from the blocker 106 inside the blocker frame 108. While the tab 116 according to this invention is present along a midpoint of the blocker 106, an alternative position along the length of the blocker and/or the corrugated strip may be desired.

When the blocker 106 is slid in one direction or another by a consumer, the tab 116 makes repeated contact with the corrugations of the strip 114 resulting in a "clicking" sound when the blocker 106 is moved. This audible notice provides another theft deterrent as the sound created alerts a store clerk that a blocker 106 is being moved, and product exposed.

Figure 8:
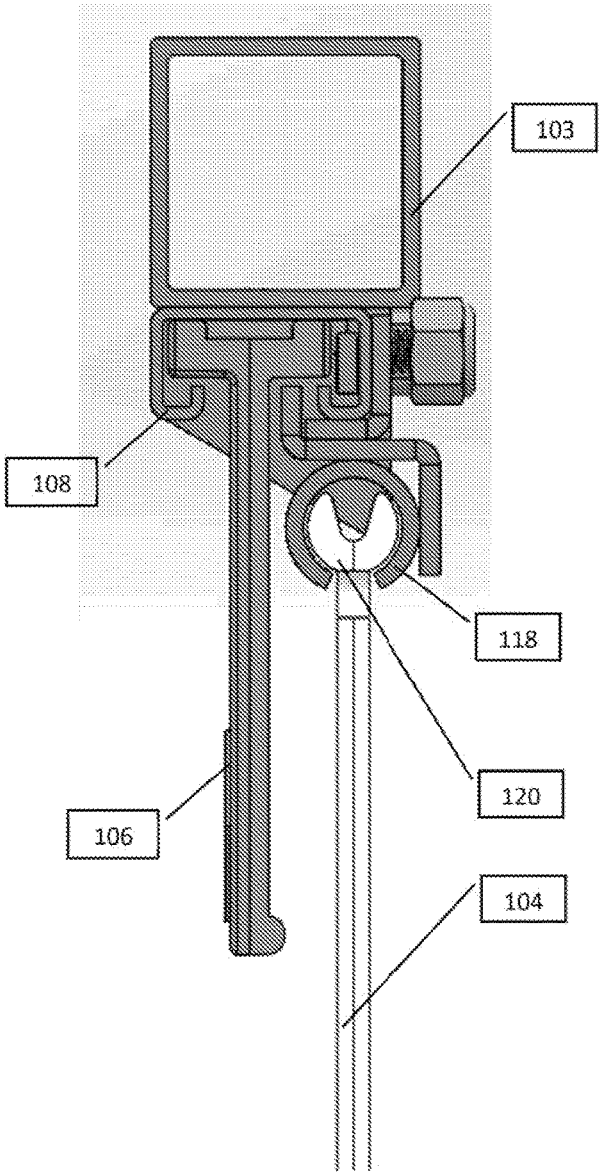
FIG. 8 shows a side cross-sectional view of a theft deterrent system according to the embodiment shown in FIG. 6.
Figure 9:
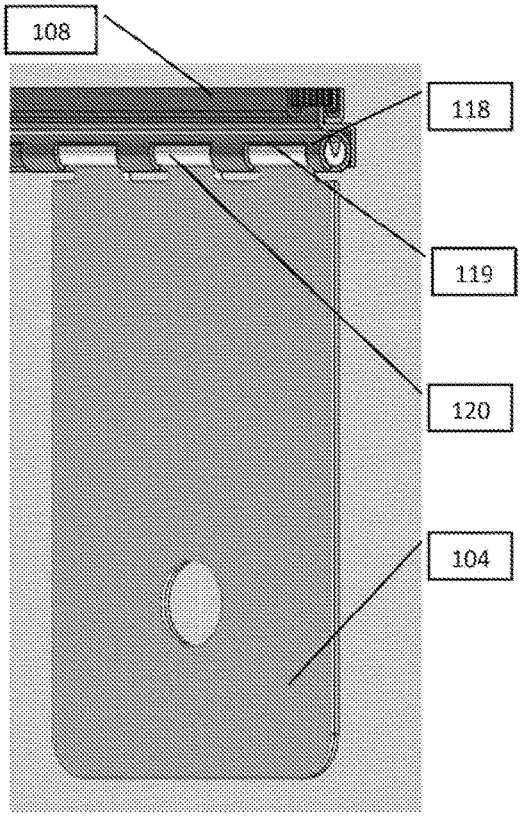
FIG. 9 shows a partial perspective view of a theft deterrent system according to the embodiment shown in FIG. 6.

FIG. 8 shows another cross-sectional side view of the system 100 including the gate 104. In this embodiment, the gate frame 103 includes an arcuate receiver component that acts as a knuckle 118 of a hinge to hold the gate 104. As such, the gate 104 preferably includes a gate spine 120 to slide into the knuckle 118, which is further shown in FIG. 9. With the inclusion of the knuckle 118, tooth/notch detail 119, and gate spine 120, the gate frame 110 allows the gate 104 to swing with approximately 90 degrees of rotation (although other degrees of rotation can be further expanded or limited depending on a desired application) through the resulting hinge.

Figure 10:
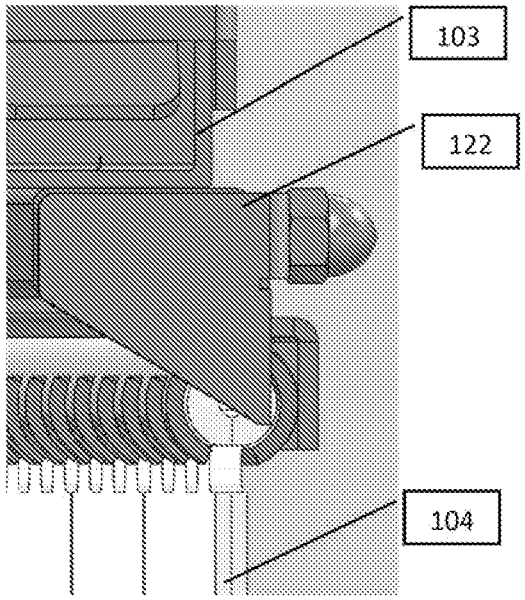
FIG. 10 shows a partial perspective view of one side of a theft deterrent system according to one embodiment of the invention.
Figure 11:
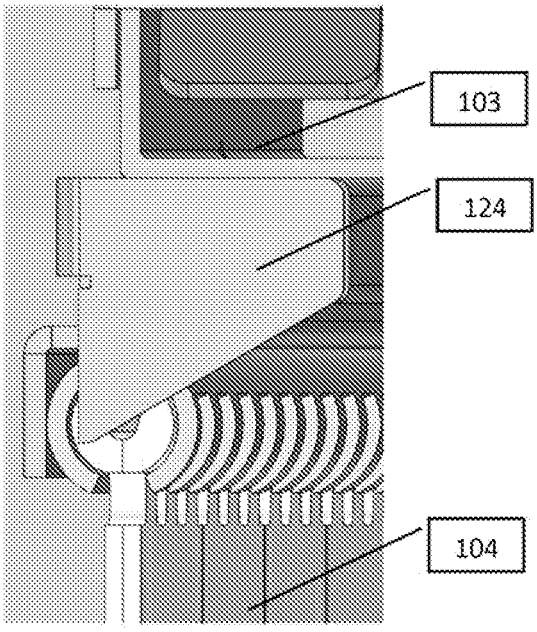
FIG. 11 shows a partial perspective view of another side of a theft deterrent system according to the embodiment shown in FIG. 10.

The system 100 also includes end caps 122 and 124 that retain both the gates 104 and blockers 106 on the frame 103. FIG. 10 shows the right end cap 122 which may be removable b a store employee, such as with a cap nut, to allow for any gates and/or blockers to be added or removed from the system. FIG. 11 shows the left end cap 124 which essentially provides the same functions of the right end cap 122, however in one embodiment, the left end cap 124 is not removable. This arrangement may be reversed depending on shelf configuration.

FIGS. 12-15 show different details relating to the receiver and blocker-frame according to embodiments of the invention. The theft deterrent system 100 may include a quick attach and release mechanism and a system to lock the gate frame 103 into the receiver 102. Portions of wall 112 of frame 103 may include a plurality of holes 126 and 141 for attaching the frame 103 to the receivers shown in FIG. 12.

Figure 12:
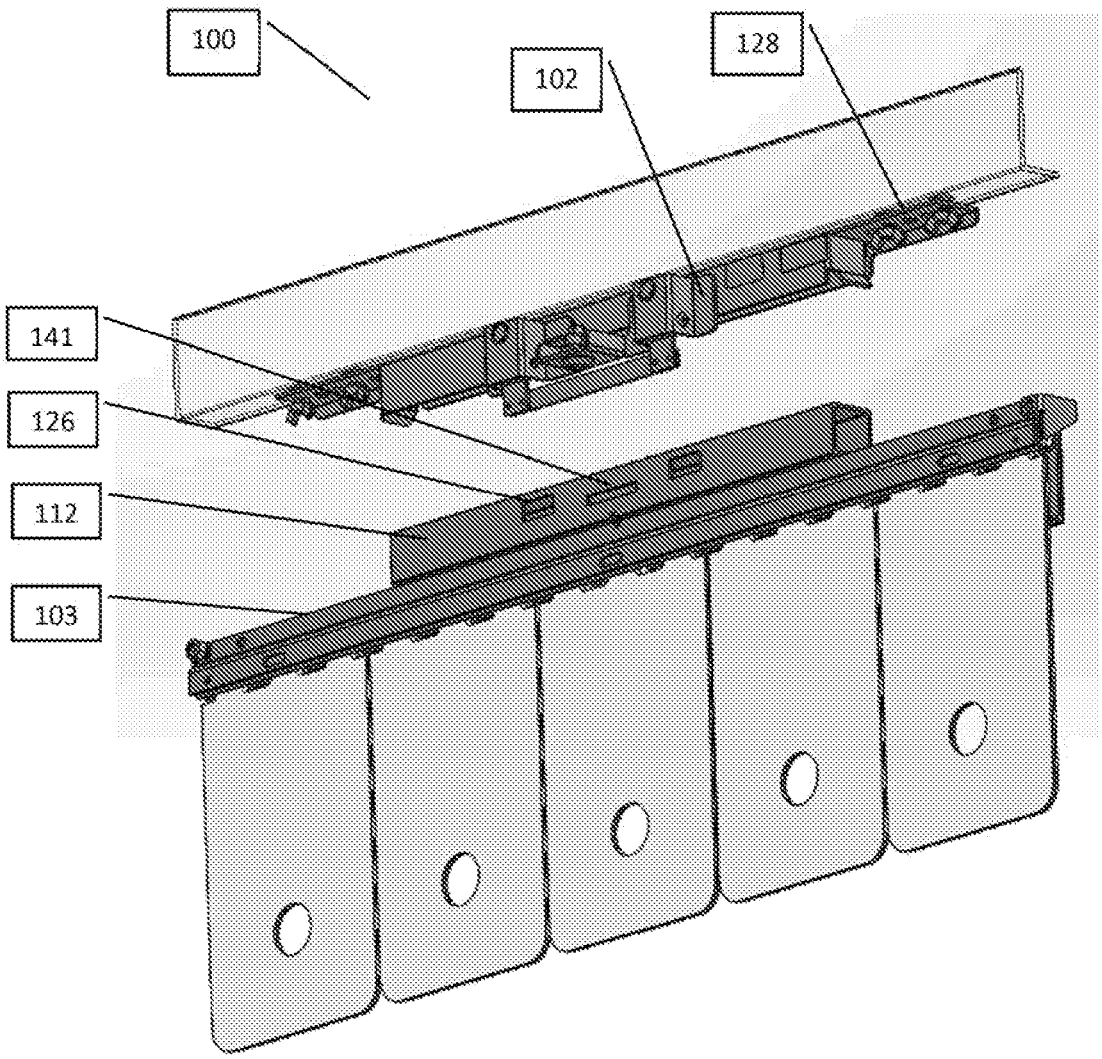
FIG. 12 shows a rear perspective view of a theft deterrent system according to one embodiment of the invention.

FIG. 12 generally shows the receiver 102 including a fastener wing 128. Each fastener wing 128 may be attached directly to a retail shelf via one or more fasteners.

Figure 13:
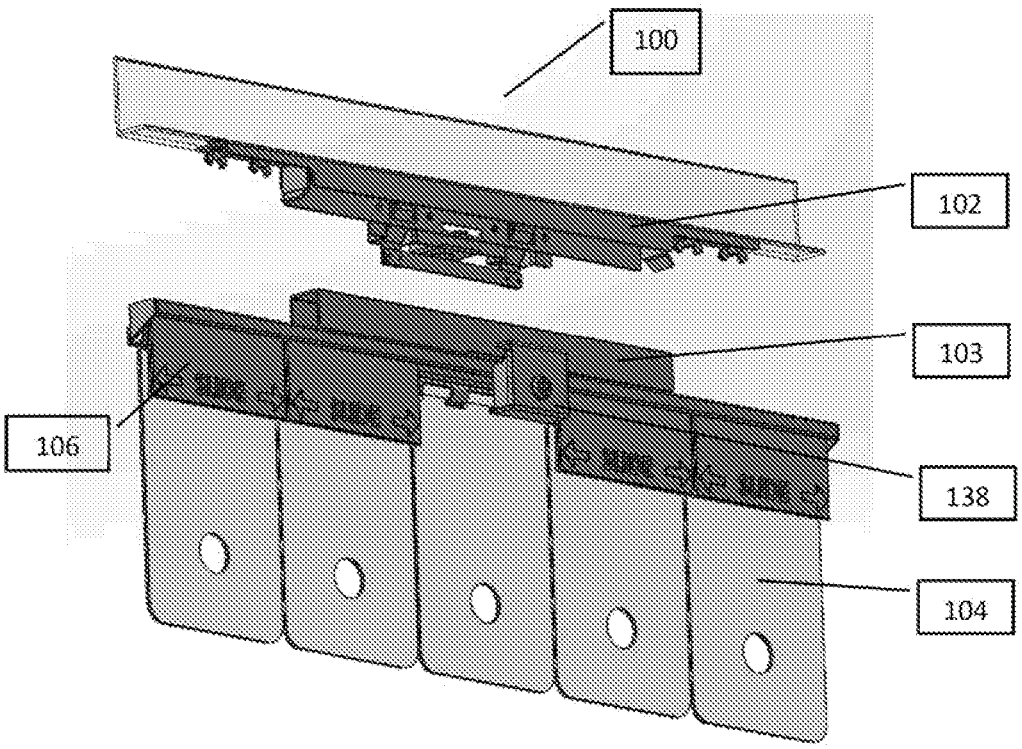
FIG. 13 shows a front perspective view the theft deterrent system according to one embodiment shown in FIG. 2.
Figure 14:
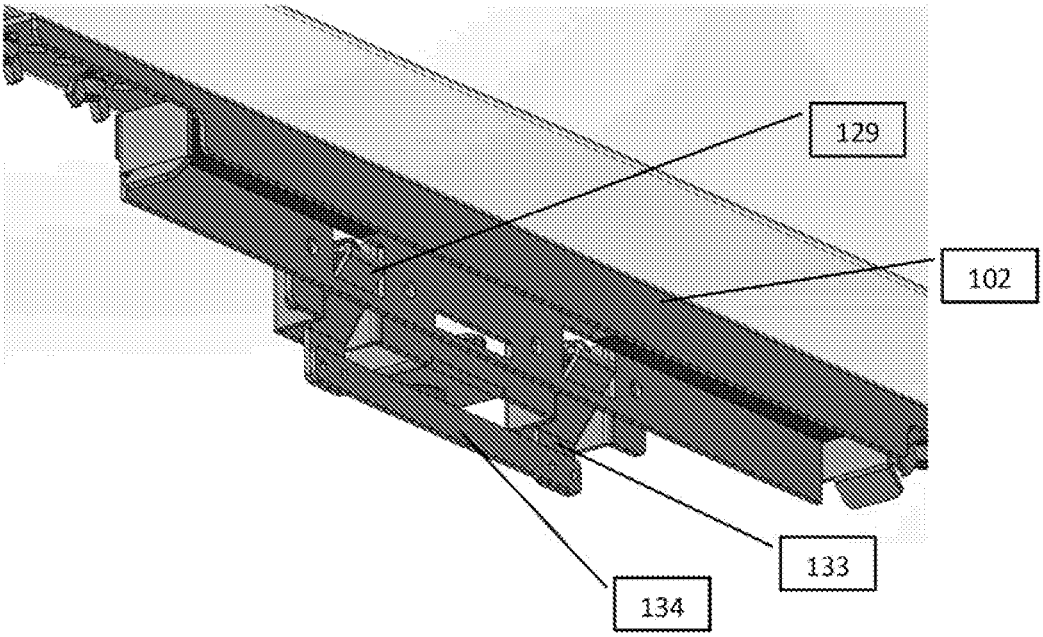
FIG. 14 shows a partial front perspective view of the theft deterrent system according to the embodiment shown in FIG. 12.

As shown in FIGS. 13-14, the receiver 102 may also include one or more snap mechanisms 129 that retract to accept the gate frame 103 and extend to retain the frame 103, FIG. 14 shows that a plurality of snap mechanisms may connect by a bar 134 that can be pressed to actuate all mechanisms at the same time with one hand.

Figure 15:
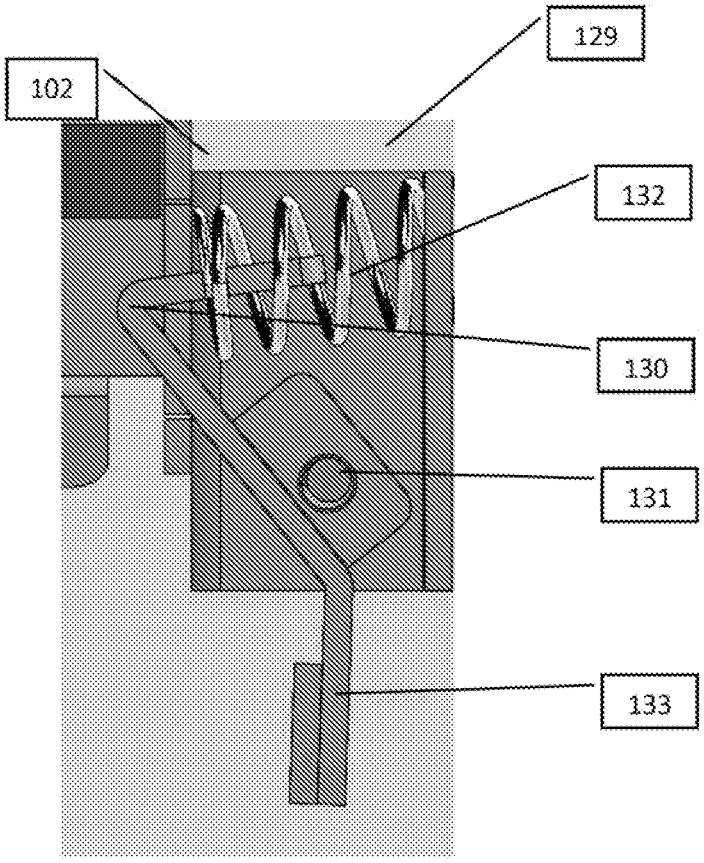
FIG. 15 shows a partial cross-sectional side view of the theft deterrent system according to the embodiment shown in FIG. 12.

FIG. 15 shows a snap mechanism 129 including a spring 132 biasing a snap tooth 130 outward. The snap tooth 130 fastens to the receiver 102 and hinges around a pin 131. The snap tooth preferably includes an opposing lever tab 133 opposite the location of the hinge pin 131. To release a gate frame 103, a user depresses the opposing lever tab 133 or bar 134 to cause the snap tooth 130 to dislodge around the pin 131 and retract into the housing of the receiver 102.

Figure 16:
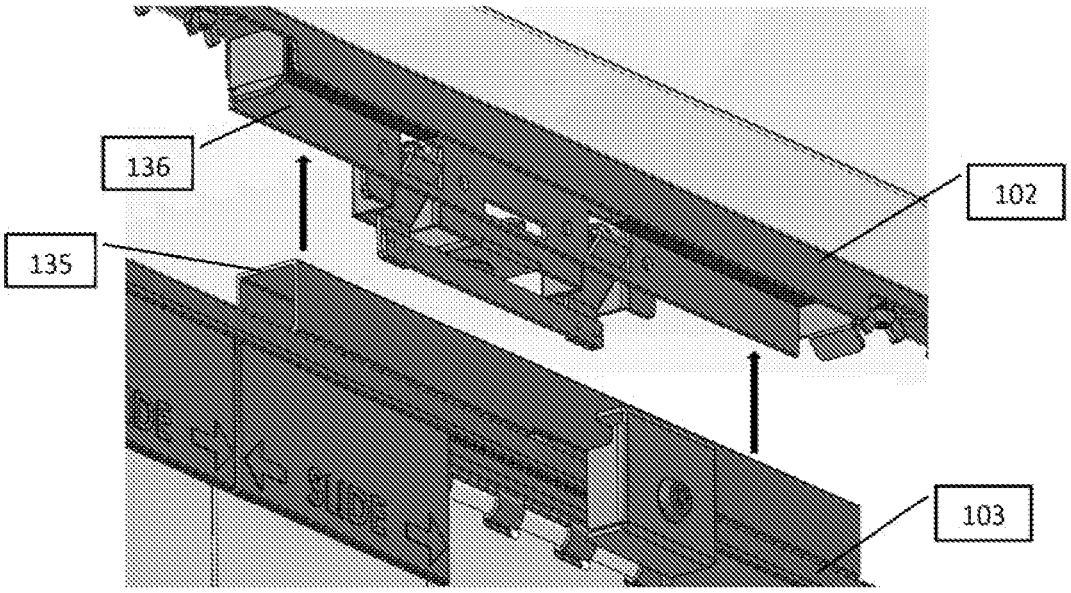
FIG. 16 shows a partial front perspective view of the theft deterrent system according to one embodiment shown in FIG. 12.

FIG. 16 shows a disengaged view of the gate frame 103 and the receiver 102. To engage the gate frame 103 to the receiver 102, a user lifts the guiding bar 135 of the gate frame 103 up into the receiving pocket 136 of receiver 102 until the snap mechanism(s) 12.9 snap into the holes 126 of wall 112 of gate frame 103. Such an arrangement permits a user/store employee to engage and disengage a whole row of gates 104 from the shelf simultaneously.

Figure 17:
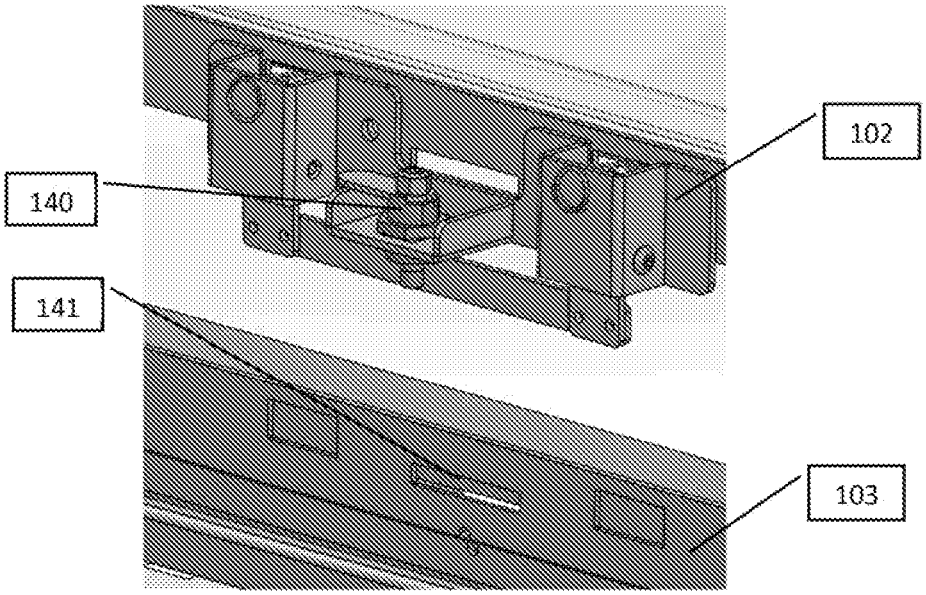
FIG. 17 shows a partial rear perspective view of the theft deterrent system according to one embodiment shown in FIG. 12.
Figure 18:
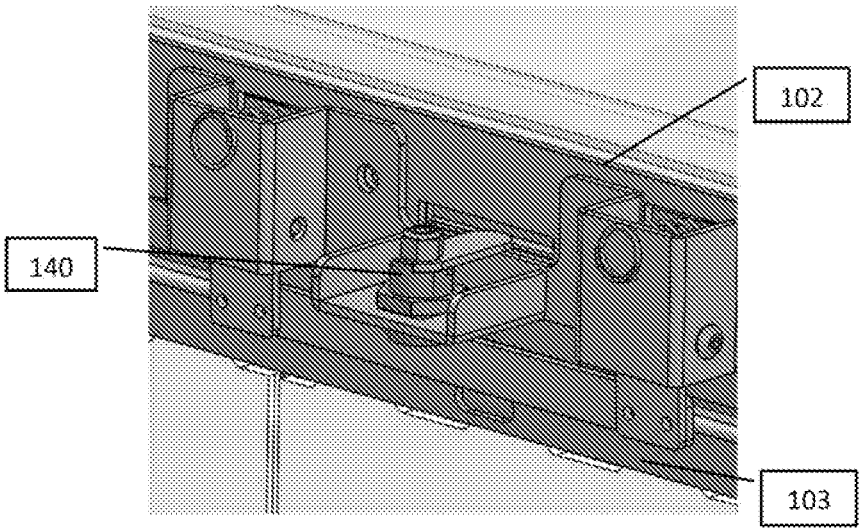
FIG. 18 shows a partial rear perspective view of the theft deterrent system according to one embodiment shown in FIG. 12.

FIGS. 17-18 show a cam lock 140 in the receiver 102 to secure the gate frame 103 via slot or hole 141 from being unsnapped or disengaged from the receiver 102.

Figure 19:
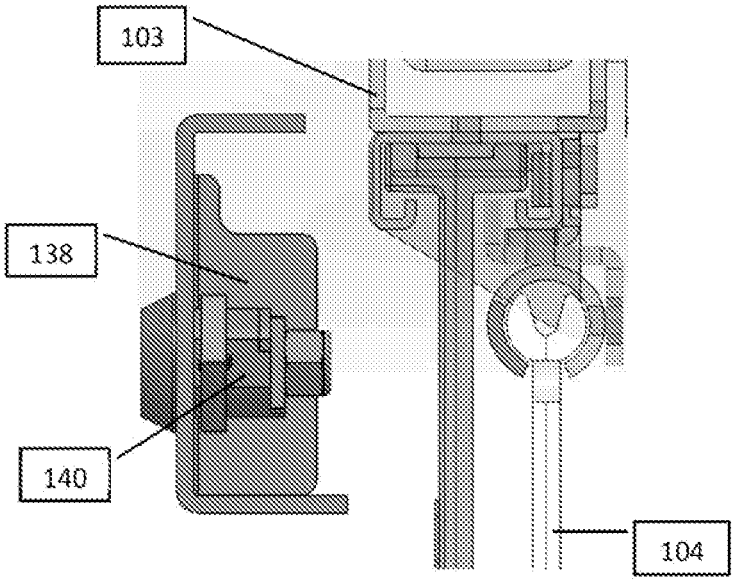
FIG. 19 shows a partial transparent side view of the theft deterrent system according to the embodiment shown in FIG. 13.
Figure 20:
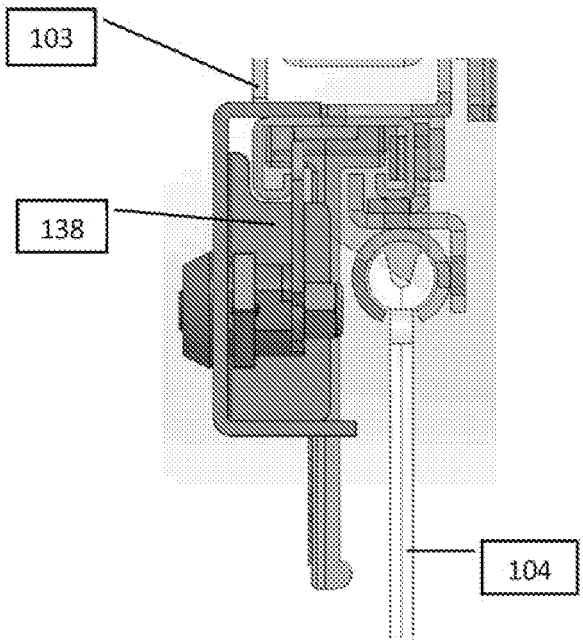
FIG. 20 shows a partial transparent side view of the theft deterrent system according to the embodiment shown in FIG. 13

FIGS. 19-20 show embodiments of the theft deterrent system 100 which may further include a removable lock box 138. The lock box 138 can be mounted on or within the gate frame 103. The lock box 138 preferably enables lockdown of one or more an/or the entire row of gates 104. When unlocked, the lock box 138 can be inserted into the gate frame 103 as shown in FIG. 19. When locked, the lock box 138 cannot be removed from the gate frame 103 as shown in FIG. 20.

FIG. 19 shows a transparent view of the lock box 138, which may contain a cam lock 140, The unlocked lock box 138 positions into the gate frame 103. The push lock 142 is preferably installed on a face of the lock box 138 (also shown in FIG. 20). The lock box 138 is secured into place when the cam lock 140 is locked turning the cam directly into the blocker channel 108. When the lock box 138 is secured, all the blockers 106 and the lock box 138 cover all the gates 104 to prevent any gate 104 from being opened. The lock 140 can also be easily removed from the system 110.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A theft deterrent system for mounting on a retail shelf, the theft deterrent system comprising:

a receiver configured to attach to the retail shelf;

a plurality of gates positioned along the receiver, each gate of the plurality of gates arranged to swing open from the receiver between an open position exposing the retail shelf and a closed position obstructing the retail shelf; and a plurality of blockers arranged in a slidable manner along the receiver, each blocker of the plurality of blockers configured to provide audible feedback as the blocker slides relative to the receiver, and each blocker configured to prevent a respective underlying gate of the plurality of gates to swing open from the receiver.

2. The theft deterrent system of claim 1 wherein the plurality of gates number one more than the plurality of blockers.

3. The theft deterrent system of claim 1 wherein the plurality of gates is transparent.

4. The theft deterrent system of claim 1 wherein the plurality of blockers are each configured to slide freely in a lateral direction relative to the receiver.

5. The theft deterrent system of claim 1 further comprising a blocker frame mounted along the receiver, wherein the plurality of blockers are positioned along the blocker frame.

6. The theft deterrent system of claim 5 wherein the audible feedback is a series of clicks as the blocker is moved relative to the blocker frame.

7. The theft deterrent system of claim 1 further comprising a gate mount assembly mounted along the receiver, wherein the plurality of gates is positioned along the gate mount assembly.

8. The theft deterrent system of claim 7 wherein the gate mount assembly comprises a gate frame and a hinge assembly for positioning the plurality of gates.

9. The theft deterrent system of claim 1 further comprising a guard strip configured to attach to the receiver above the plurality of gates and plurality of blockers.

10. A theft deterrent system for mounting on a retail shelf, the theft deterrent system comprising:

a receiver configured to attach to the retail shelf;

a plurality of gates positioned along the receiver, each gate of the plurality of gates arranged to swing open from the receiver between an open position exposing the retail shelf and a closed position obstructing the retail shelf; and a plurality of blockers arranged in a slidable manner along the receiver and relative to the plurality of gates, wherein a number of the blockers is less than a number of the gates, and each blocker is configured to prevent at least one respective underlying gate of the plurality of gates to swing open from the receiver.

11. The theft deterrent system of claim 10 wherein each blocker of the plurality of blockers is configured to provide audible feedback as the blocker slides relative to the receiver.

12. The theft deterrent system of claim 10 wherein the plurality of gates is transparent.

13. The theft deterrent system of claim 11 further comprising a blocker frame mounted along the receiver between the plurality of blockers and the receiver, wherein the plurality of blockers are positioned along the blocker frame.

14. The theft deterrent system of claim 13 wherein the audible feedback is a series of clicks as the blocker is moved relative to the blocker frame.

15. The theft deterrent system of claim 10 further comprising a gate mount assembly mounted along the receiver, wherein the plurality of gates is positioned along the gate mount assembly.

16. The theft deterrent system of claim 15 wherein the gate mount assembly comprises a gate frame and a hinge assembly for positioning the plurality of gates.

17. The theft deterrent system of claim 1 further comprising a lock box positioned relative to the plurality of gates, the lock box configured to fixedly lock one or more gates of the plurality of gates into the closed position.

* * * * *